United States Patent [19]

Capuano

[11] Patent Number: 4,819,864

[45] Date of Patent: Apr. 11, 1989

[54] CARTON AND BLANK FOR PACKING ICE CREAM AND THE LIKE

[75] Inventor: Frank G. Capuano, Rochester, N.Y.

[73] Assignee: Rolph-Clark-Stone Packaging Corp., Newport News, Va.

[21] Appl. No.: 183,934

[22] Filed: Apr. 20, 1988

[51] Int. Cl.[4] ..... B65D 5/02

[52] U.S. Cl. ..... 229/135; 206/624; 229/145; 229/154; 229/169; 229/905

[58] Field of Search ..... 229/132, 135, 145, 154, 229/169, 3.1, 905; 206/611, 624, 629, 631, 626

[56] References Cited

U.S. PATENT DOCUMENTS

| | | | |
|---|---|---|---|
| 3,239,129 | 3/1966 | Schilling et al. | 206/611 |
| 4,405,066 | 9/1983 | Roccaforte | 206/624 |
| 4,555,027 | 11/1985 | Froom | 206/626 |
| 4,669,614 | 6/1987 | Froom | 206/624 |
| 4,712,730 | 12/1987 | Froom | 229/169 |
| 4,756,470 | 7/1988 | DePaul | 206/611 |

*Primary Examiner*—David T. Fidei

*Assistant Examiner*—Gary E. Elkins

*Attorney, Agent, or Firm*—Shlesinger, Arkwright & Garvey

[57] ABSTRACT

A carton for packaging ice cream and the like is disclosed comprising a receptacle, including front, bottom, rear, and cover panels hingely connected in series. The cover panel includes a closure flap having means for securing to the front panel. The panels include left and right end flaps hingely connected to the respective panels. The end flaps are dimensioned to form a substantially sealed right and left ends of the carton. Hinge line shoulders formed inwardly are provided for lateral support to the bottom panel end flaps in the folded position and prevent the end flaps from folding in further into the carton from a substantially perpendicular position with the bottom panel. The front and rear edges of the bottom panel end flaps are tapered such that they engage with the hingeline shoulders in the erected position and prevents bowing to the front and rear panels of the carton.

12 Claims, 4 Drawing Sheets

FIG 2
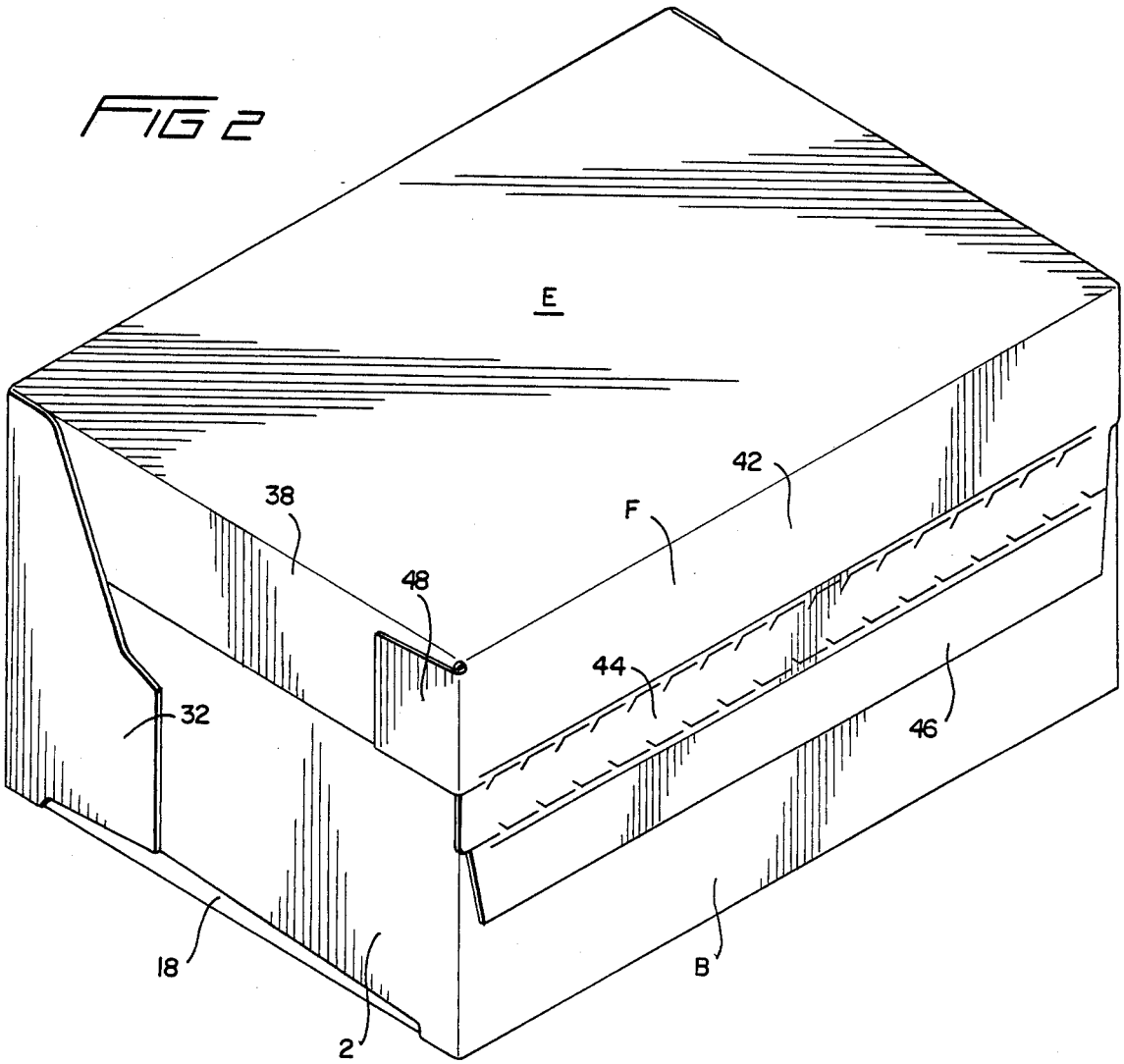
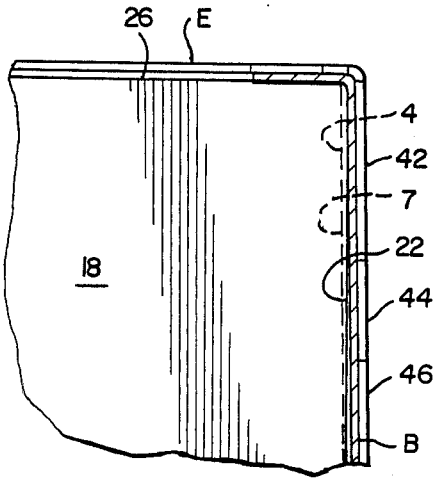
FIG 4

PRIOR ART-
BOTTOM PANEL END FLAP

CARTON AND BLANK FOR PACKING ICE CREAM AND THE LIKE

FIELD OF THE INVENTION

This invention pertains to a blank and a carton for packaging ice cream and the like. The following pending U.S. patent applications are assigned to the assignee of the present application: A Carton and Blank for Packaging Ice Cream and the Like, Ser. No. 07/021,649; An Ornamental Design for a Carton for Packaging Ice Cream and the Like, Ser. No. 07/046,505; and A Carton and Blank for Packaging Ice Cream and the Like, Ser. No. 07/106,877.

BACKGROUND OF THE INVENTION

A carton for packaging ice cream or the like is normally made from a single carton blank. In the prior art, the blank generally comprises front, bottom, rear, and cover panels. The cover panel is usually provided with end flaps and a front closure flap which form a recloseable cover when erected. The other panels are also provided with end flaps that form a tight seal for the ends of the carton. The cover panel and the bottom panel are normally dimensioned the same, and so are the rear and front panels. The bottom panel end flaps are normally full end flaps, meaning that in the erected position, the end flaps cover the whole opening in each end of the carton. In the erected position, it will be noted that the inside dimension, looking at the end of the carton, is not a rectangle but rather in the shape of a trapezoid. The reason is that the cover panel closure flap overlaps the front panel in the erected position forcing the front panel inward by the width of the carton material, and in combination with the fact that the cover panel and the bottom panel are of the same width. The bottom panel end flaps are normally cut into a shape of a rectangle. Therefore, one can see that when the bottom panel end flap is folded into the end of the carton which is in the shape of a trapezoid, a perfect fit is not possible. This results in buckling of the front and rear panels when the rectangular bottom panel end flap is forced into the trapezoidal end opening of the carton. The resulting disfigurement of the carton provides less than perfect seal for the ends of the carton. It also presents a not too attractive package to the consumer.

However, there are other carton configurations where the end panels are substantially vertical with the bottom panel and forms a rectangular opening with the cover panel and the bottom panel end flap when folded in has a width dimension greater than the inside dimension between the end panels. These configurations also cause buckling.

OBJECTS AND SUMMARY OF THE INVENTION

It is therefore an object of the invention to provide a carton for ice cream or the like that has a good seal in the ends.

It is another object of the invention to provide a carton that is pleasing to the eyes.

It is a further object of the invention to provide a carton which will retain a semi-liquid content without leaking.

It is yet another object of the invention to provide a bottom panel end flap which when folded in will stay folded substantially perpendicular to the bottom panel.

Another object of the invention is to provide lateral support which will limit the further inward movement of the bottom panel end flap in the erected position even with the clearance provided in the end flap.

It is still another object of the invention to provide a bottom panel end flap which when folded in will seat itself against the hinge line shoulder, thus preventing the bottom panel end flap from further folding into the carton.

It is yet another object of the invention to provide a carton that is readily adaptable for use in presently existing carton erecting and filling equipment.

It is also an object of the invention to allow for an end flap which has an overall dimension greater than the inside dimension between two panels to go in easily without forcing the panels outwardly.

It is an object of the invention to eliminate bowing at the front and rear panels of the carton.

It is another object of the invention to allow an end flap to fold in without causing bowing of end walls.

In summary, the present invention discloses a novel design for a carton blank including bottom panel end flaps that are appropriately shaped to fit the end opening of the carton to achieve an excellent seal.

DESCRIPTION OF THE DRAWINGS

FIG. 2 is an isometric view of a carton formed and erected from the carton blank of FIG. 1.

FIG. 4 is a sectional view taken from FIG. 6, showing the bottom panel end flap engaged with the outside surface of the hinge line shoulder formed by the hinge line between the front panel and its associated end flap.

DETAILED DESCRIPTION OF THE INVENTION

Figure 1:
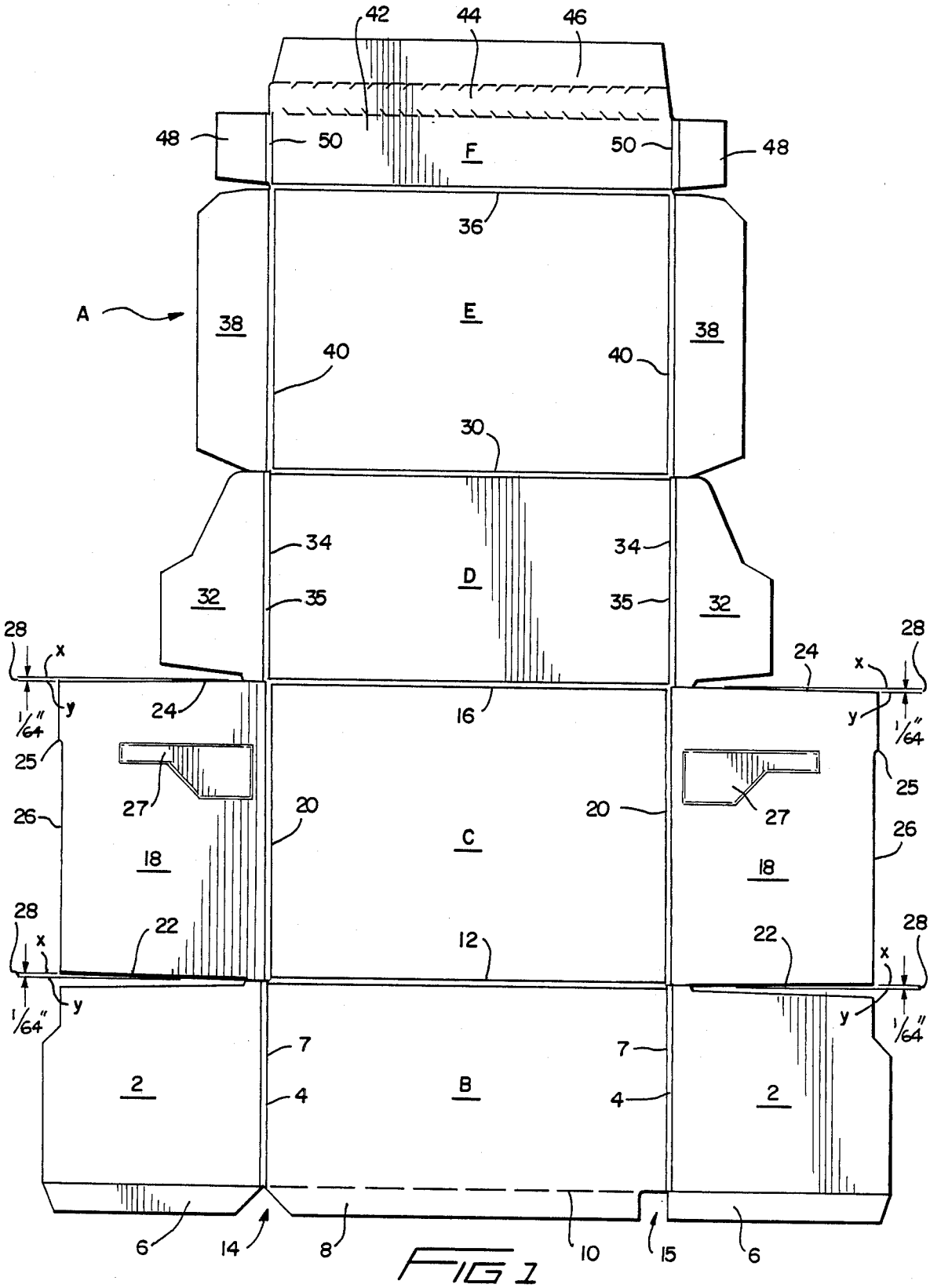
FIG. 1 is a plan view of the inner surface of a flat carton blank showing the bottom panel end flap dimensioned in accordance with the present invention.

The invention will now be described with specificity. Referring to FIG. 1, there is disclosed a carton blank A. Carton blank A comprises a front panel B, a bottom panel C, a rear panel D, a cover panel E and a closure flap F.

Figure 9:
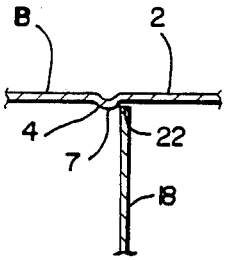
FIG. 9 is a sectional view taken from FIG. 6 showing the relationship of the edge of the bottom panel end flap to the hinge line shoulder.

Front panel B has end flaps 2 hingedly connected to it by hinge lines 4, and bottom panel end flaps 2 have membrane flaps 6 hingedly connected thereto. Hinge lines 4 form hinge line shoulders 7 as shown in FIG. 9. Membrane flaps are connected to front panel B by slit lines 10. Front panel B is hingely connected to bottom panel C by hinge line 12. Cutouts 14 and 15 are configured such that in the erected carton, membrane flaps 6 and 8 lie in the same plane, and that membrane flaps 6 fit into the steps 26.

Bottom panel C is hingely connected to front panel B by hinge line 12 and to rear panel D by hinge line 16. Bottom panel end flaps 18 are hingedly connected to bottom panel C by hinge lines 20. Bottom panel end flaps 18 have front edges 22, rear edges 24, top edges 25, steps 26 for receiving membrane flaps 6 and embossed areas 27 for receiving glue during carton erection. Bottom panel end flaps 18 are full end flaps with an area substantially equal to the area of the carton end when erected. In accordance with this invention, it will be noted that front edges 22 and rear edges 24 are tapered or beveled from hinge lines 20 toward each other to the top edges 25 by an amount generally indicated by 28 which is the distance between dimension lines X and Y. The taper 28 is equal to about ½ the thickness of the carton material. For example, the taper 28 is indicated as 1/64 inch for a material having thickness of 0.023 inch.

Figure 7:
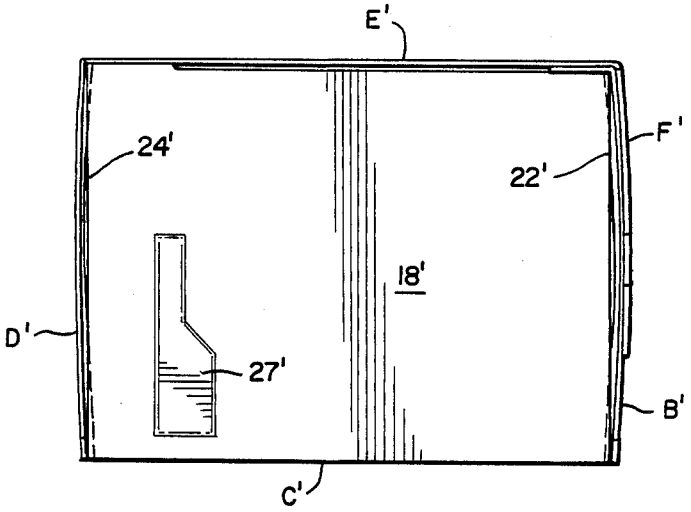
FIG. 7 is a view of a prior art carton looking at the end of the carton, with the bottom panel end flap folded in into the carton opening.

Rear panel D is hingedly connected to bottom panel C by hinge line 16 and to cover panel E by hinge line 30. Rear panel end flaps 32 are hingedly connected to rear panel D by hinge lines 34. Hinge lines 34 form hinge line shoulders 35 as shown in FIG. 7.

Cover panel E is hingely connected to rear panel D by hinge line 30 and to cover flap F by hinge line 36. Cover panel end flaps 38 are hingely connected to cover panel E by hinge lines 40.

Closure flap F is hingedly connected to cover panel E by hinge line 36 and comprises a reclosable flap 42, a tear strip 44 and a glue flap 46. Glue tabs 48 are hingely connected to closure flap F by hinge lines 50.

ALTERNATE EMBODIMENT

Figure 8:
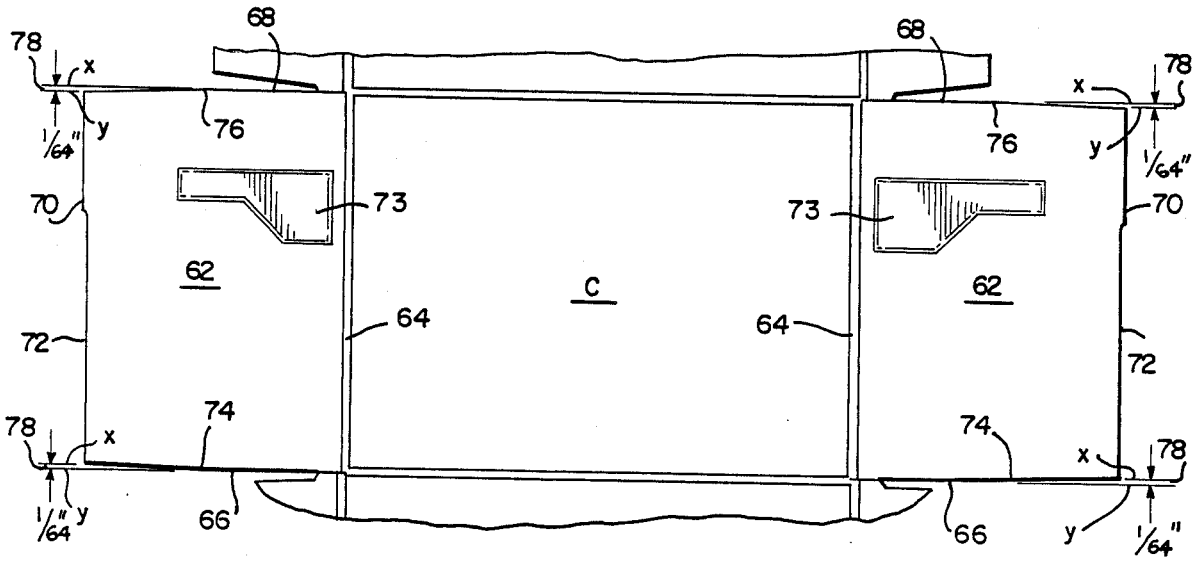
FIG. 8 is an embodiment of the bottom panel end flap dimensioned according to the invention.

FIG. 8 shows an alternative embodiment of the invention. Bottom panel C is hingely connected to bottom panel end flaps 62 by hinge lines 64. Bottom panel end flaps 62 have front edges 66 and rear edges 68, including top edges 70 and steps 72 for receiving membrane flaps during assembly. Embossed areas 73 are for receiving glue during carton erection. Points 74 and 76 are substantially mid-way between hinge lines 64 and top edges 70 on front edges 66 and rear edges 68, respectively. Front edges 66 and rear edges 68 are tapered or beveled starting from points 74 and 76 towards each other to the top edges 70 by an amount generally indicated by 78 which is the distance between dimension lines X and Y. The taper 78 is equal about to ½ the thickness of the carton material. For example, for carton thickness of 0.023 inch, the taper 78 would be 1/64 inch.

CARTON ASSEMBLY

The carton blank A when completely assembled is depicted in FIG. 2. To assemble the carton blank A, shown in FIG. 1, front panel B is folded along hinge line 12 such that it overlies a portion of bottom panel C. Cover panel E is folded along hinge line 30 such that closure flap F overlies front panel B. Glue is applied on glue flap 46 such that closure flap F is securely joined to cover panel B. The carton is then erected into a cylinder as best shown in FIG. 3.

The end flaps are then folded in to seal the carton end. Bottom panel end flap 18 is first folded inwardly so that it is substantially perpendicular with bottom panel C. Front panel end flap 2 is then folded inward such that membrane 6 fits into the step 26 and overlies bottom panel end flap 18. Cover panel end flap 38 is next folded inward to overlie front panel end flap 2 and bottom panel end flap 18. An adhesive strip is then applied on bottom panel end flap 18 in the embossed area 27 adjacent to the front panel end flap 2. Subsequently, rear panel end flap 32 is folded inwardly to overlay cover panel end flap 38, bottom panel end flap 18 and front panel end flap 2. Pressure is applied on rear panel end flap 32 to fasten rear panel end flap 32 to bottom panel end flap 18 and front panel end flap 2. Finally glue tab 48 is folded along hinge line 50 to overlay cover panel end flap 38. Adhesive is applied on cover panel end flap 38 to secure the glue tab 48.

Figure 3:
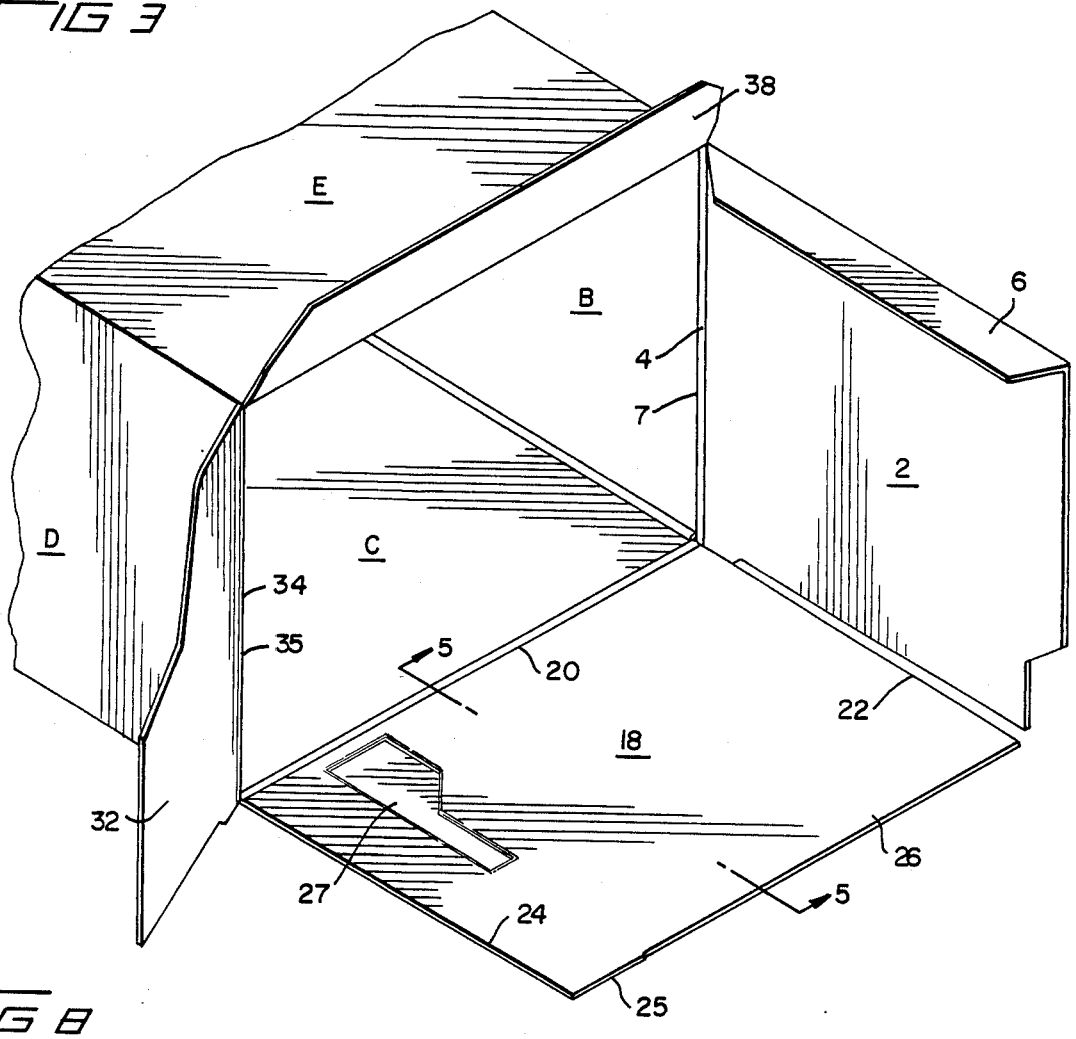
FIG. 3 is an isometric view of the end of the carton with the end flaps shown prior to being folded in to seal the carton end.
Figure 5:
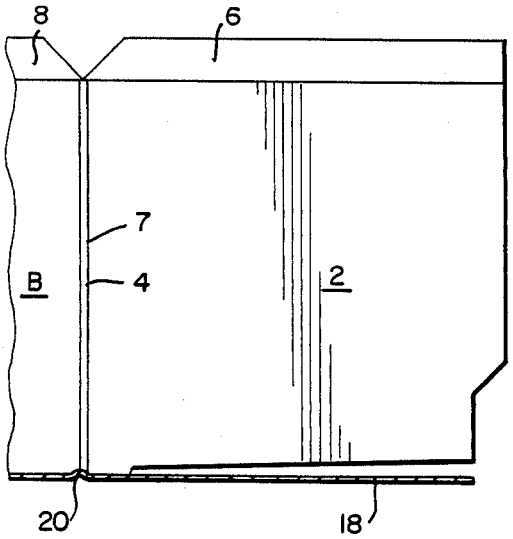
FIG. 5 is a sectional view taken from FIG. 3 showing the bottom panel end flap in the horizontal position.

The hinge line 4 forms a hinge line shoulder 7, as shown in FIGS. 3, 5 and 9. Hinge line 34, as shown in FIG. 1, also forms similar hinge line shoulder 35. When bottom panel end flap 18 is folded upwardly along hinge line 20, the front edge 22 and rear edge 24 of the bottom panel end flap 18 will engage with hinge line shoulders 7 and 35 of hinge lines 4 and 34, respectively, to provide lateral support to the edges. This is best shown in FIG. 9, where front edge 22 of bottom end flap 18 is shown engaged with hinge line shoulder 7 of hinge line 4.

Figure 6:
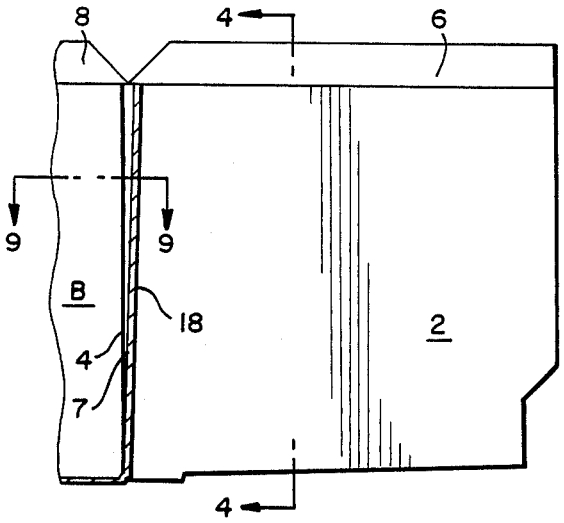
FIG. 6 shows the bottom panel end flap folded perpendicularly to the bottom panel and engaged with the hinge line shoulder formed by hinge line between the front panel and its associated end flap.

In the prior art carton, shown in FIG. 7, when bottom panel end flap 18′ including embossed area 27′ is folded upward in a manner similar to the invention as in FIG. 6, the front panel B′ with the overlying closure flap F′ and the rear panel D′ tend to bow out because of a difference in dimension between the actual cross-sectional opening at the end of the carton and the dimensions of the bottom panel end flap 18′. Specifically, referring to FIG. 7, the dimensions of the cross-sectional opening of the carton end at the top is less than the dimension of the opening at the bottom by an amount substantially equal to the thickness of the carton material used. This is so because all the panels are laid out with the same width and when the carton is assembled, the closure flap F′ overlaps the front panel B and forces it inwardly by an amount substantially equal to the thickness of the material. The resulting opening is a trapezoid. When the prior art bottom panel end flap 18′ is folded inwardly into the opening, the sides 22′ and 24′ of the bottom panel end flap push out the front panel B′ and rear panel D′. The bowing out of the front panel B′ and the rear panel D′ makes for an imperfect seal in the carton end, causing leakage around the joints when the carton is filled with semi-liquid ice cream prior to freezing. It has been found that when this happens, leakage tends to occur through the edges. To eliminate the bowing effect and the resulting leakage, the bottom panel end flaps 18′ are tapered along the front edges 22′ and rear edges 24′ to better fit them into the actual opening of the carton ends.

Even if the front panel B′ and rear panel D′ are perpendicular to the bottom panel C′, and forms a rectangular cross sectional opening with the cover panel E′, the bottom panel end flap 18′ is still required to have clearance to avoid the bowing effect and resultant poor seal. When the front panel B′ and rear panel D′ are folded up, approximately ½ the thickness of each of the panels projects into the carton inside space, thus reducing the cross-sectional width opening of the carton end by at least one thickness of the material. The width of the bottom panel end flap 18′, dimensioned the same as the width of the bottom panel C′, will then be larger than the width of the carton end opening between the front panel B′ and rear panel D′ by an amount substantially equal to the thickness of the material.

FIG. 4 shows the bottom end flap 18 properly tapered according to the invention to properly fit it into the carton end opening. Front edge 22 of the bottom end flap 18 is shown engaged with the hinge line shoulder 7 of hinge line 4. This prevents the end flap 18 from folding further into the carton and provides a tighter seal around the front edges 22 and rear edges 24 of the end flap 18. Bowing of the front panel B and rear panel D is eliminated. An overall tighter seal for the carton end is thus made.

In the embodiment of the invention, as best shown in FIG. 1, the taper on front edges 22 and rear edges 24 starts at hinge lines 20 and end at top edges 25, and is an amount equal to about one-half the thickness of the material for each edge, such that top edges 25 are shorter than the inner edges at hinge lines 20 by a thickness of the material. For example, the amount of taper 28 between the dimension lines X any Y is 1/64 inch for a material having a thickness of 0.023 inch.

In the embodiment of the invention as best shown in FIG. 8, the taper starts approximately at mid-points 74 and 76 of the front edges 66 and rear edges 68 of bottom panel end flaps 62. The amount of taper on each edge of bottom panel end flaps 62 is also equal to about one-half the thickness of the material such that top edges 70 are shorter approximately by a thickness of the material than the inner edges at hinge line 20. For example, for a material having a thickness of 0.023 inch, the taper 78 between dimension lines X any Y is 1/64 inch.

While this invention has been described as having preferred design, it is understood that it is capable of further modification, uses and/or adaptations of the invention following in general the principle of the invention and including such departures from the present disclosure as come within known or customary practice in the art to which the invention pertains, and as may be applied to essential features set forth, and fall within the scope of the invention or the limits of the appended claims.

What is claimed is:

1. A carton for packaging ice cream and the like, comprising;

(a) a receptacle, including operably connected front, bottom and rear panels;

(b) said front panel and said rear panel each having top, bottom, left and right edges;

(c) said bottom panel having front, rear, left and right edges;

(d) said front panel being operably connected at its bottom edge to said front edge of said bottom panel;

(e) said bottom panel being operably connected at its rear edge to said bottom edge of said rear panel;

(f) a cover including a cover panel having front, rear, left and right edges;

(g) said cover further including a closure flap;

(h) said cover panel being operably connected at its rear edge to said top edge of said rear panel;

(i) means for securing said closure flap to said front panel;

(j) said panels each having left and right end flaps connected to said left and right edges respectively forming hinge lines therebetween;

(k) said left and right front panel end flaps each having a membrane flap extending from said top edges;

(l) said front panel having a membrane flap extending from said top edge of said front panel;

(m) said left and right front panel end flap membranes and said front panel membrane forming a substantially continuous lip extending inwardly and along and at least a portion of the outer periphery of said receptacle;

(n) said end flaps having dimensions to form a substantially sealed right and left ends of said carton;

(o) said end flaps of said bottom panel including front, rear, outer and inner edges;

(p) hinge line shoulders formed inwardly by said hinge lines between said panels and said end flaps to provide lateral support to said bottom panel end flaps along substantially said entire front and rear edges of said bottom panel end flap in the erected position;

(q) said dimensions of said end flaps of said bottom panel are such that they engage said hinge line shoulders when in the erected position and prevents bowing of said front and rear panels; and (r) said dimension of said bottom panel end flaps includes a taper on said front and rear edges such that said outer edge is narrower than said inner edge.

2. A carton for packaging ice cream and the like, as in claim 1, wherein:

(a) said outer edge is narrower than said inner edge by an amount equal to about the thickness of the material of said carton.

3. A carton for packaging ice cream and the like, as in claim 2, wherein:

(a) said tapers on each of said front and rear edges are substantially equal to each other.

4. A carton for packaging ice cream and the like, as in claim 3, wherein:

(a) said tapers begin at points spaced from said inner edge and include portions perpendicular to said inner edge.

5. A carton for packaging ice cream and the like, as in claim 3, wherein:

(a) said taper on each of said front and rear edges is substantially equal to 1/64 inch.

6. A carton for packaging ice cream and the like, as in claim 4, wherein:

(a) said tapers start from points adjacent said inner edges.

7. A carton for packaging ice cream and the like, as in claim 4, wherein:

(a) said tapers start from points at said inner edges.

8. A carton for packaging ice cream and the like, as in claim 4, wherein:

(a) said tapers start from a point substantially at the midpoint of said front and rear edges.

9. A carton for packaging ice cream and the like, as in claim 4, wherein:

(a) said taper on each of said front and rear edges is substantially equal to 1/64 inch.

10. A carton for packaging ice cream and the like, as in claim 6, wherein:

(a) said taper on each of said front and rear edges is substantially equal to 1/64 inch.

11. A carton for packaging ice cream and the like, as in claim 7, wherein:

(a) said taper on each of said front and rear edges is substantially equal to 1/64 inch.

12. A carton for packaging ice cream and the like, as in claim 8, wherein:

(a) said taper on each of said front and rear edges is substantially equal to 1/64 inch.

* * * * *